US005475358A

United States Patent [19]

Kotani et al.

[11] Patent Number: 5,475,358

[45] Date of Patent: Dec. 12, 1995

[54] HIGH-VOLTAGE VARIABLE RESISTOR UNIT

[75] Inventors: Hirokaza Kotani, Yatsuo; Hiromasa Saikatsu, Himi; Hitoshi Ishiwari, Toyama; Kenichi Hiraki, Inami, all of Japan

[73] Assignee: Hokuriku Electric Industry Co., Ltd., Toyama Pref., Japan

[21] Appl. No.: 214,645

[22] Filed: Mar. 17, 1994

[30] Foreign Application Priority Data

Mar. 17, 1993 [JP] Japan ..... 5-011868 U

[51] Int. Cl.[6] ..... H01C 10/10; H01C 1/02

[52] U.S. Cl. ..... 338/70; 338/118; 338/128; 338/184; 338/193; 338/273; 338/219

[58] Field of Search ..... 338/118, 128, 338/275, 274, 322, 193, 184, 199, 277, 219, 70

[56] References Cited

U.S. PATENT DOCUMENTS 4,402,037 8/1983 Iwamura et al. ..... 338/219 X 4,471,339 11/1984 Fukada et al. ..... 338/162

FOREIGN PATENT DOCUMENTS 62-192601 5/1986 Japan ..... H01C 1/14

OTHER PUBLICATIONS

Japanese Utility Model Application Laid–Open Publication No. 116005/1991.

Japanese Utility Model Application Laid–Open Publication No. 32504/1992.

Japanese Utility Model Publication 18904/1985.

*Primary Examiner*—Marvin M. Lateef

*Attorney, Agent, or Firm*—Pearne, Gordon, McCoy & Granger

[57] ABSTRACT

A high-voltage variable resistor unit capable of simply and positively connecting, to a holder of a high-voltage fixed resistor used as a bleeder resistor, a wire-like terminal inserted into an electrically conductive rubber terminal provided on a side of a fly-back transformer. An insulating substrate which is formed thereon with a resistance pattern including a pair of electrodes respectively connected to first and second lead wires is received in a holder of a hollow shape made of insulating resin. The holder includes a holder body formed with an opening through which the insulating substrate is received. A wire-like terminal formed by being a rigid metal wire is heldly fitted in terminal fitting members provided on an outside of the holder. The terminal fitting members includes at least one terminal fitting member provided a wall of the holder facing the opening of the insulating casing and at least one terminal fitting member provided on one of side walls of the holder adjacent to the wall.

11 Claims, 4 Drawing Sheets

HIGH-VOLTAGE VARIABLE RESISTOR UNIT

BACKGROUND OF THE INVENTION

This invention relates to a variable resistor unit for a high voltage (hereinafter referred to as "high-voltage variable resistor unit"), and more particularly to a high-voltage fixed resistor for a high-voltage Variable resistor unit.

In the art, there has been conventionally used a high-voltage variable resistor unit commonly called a focus pack for controlling a focus voltage of a cathode ray tube (CRT) or a screen voltage thereof. The conventional high-voltage variable resistor unit is generally mounted on a transformer casing of a fly-back transformer. A high-voltage variable resistor unit of the type of being decreased in output voltage is conventionally constructed in such a manner that a resistance pattern for a variable resistor and a resistance pattern for a fixed resistor called a bleeder resistance which is connected in series to the resistance pattern for the variable resistor are formed on a single substrate. Unfortunately, the high-voltage variable resistor unit of this type, when the voltage is increased, tends to cause discharge between the resistor patterns and/or between each of the resistor patterns and an electrode. In order to solve the problem, an approach that the fixed resistor called a bleeder resistor which is arranged on a high voltage side is received in another receiving section while being mounted on another insulating substrate is employed.

Conventionally, a holder is used for receiving the insulating substrate on which the fixed resistor is formed in the insulating case. For example, Japanese Utility Model Application Laid-Open publication No. 116005/1991 discloses a high-voltage variable resistor unit including a holder which is adapted to hold an end of an insulating substrate for a fixed resistor while keeping a large part of the substrate exposed. The holder is fixed in an insulating casing through a fitting structure. Then, the insulating casing is combined with a fly-back transformer, followed by being charged therein with thermosetting insulating resin for molding of the fly-back transformer. Use of the holder wherein a large part of the insulating substrate is exposed exhibits an advantage that the insulating substrate as well as the transformer is molded by the insulating resin. However, it has a disadvantage that occurrence of any crack in the insulating resin cured often causes discharge to occur at a high-voltage region on the insulating substrate. In view of the disadvantage, a holder which is formed into a one-side-open hollow shape so as to receive an insulating substrate therein is proposed, as disclosed in Japanese Utility Model Application Laid-Open Publication No. 32504/1992. In the Japanese publication, an insulating substrate on which an input lead wire and an output lead wire are respectively connected to electrodes in a pair each arranged on each of both ends of a resistance pattern for a fixed resistor is received in a holder, which is charged therein with insulating resin for molding, resulting in providing a high-voltage fixed resistor. The high-voltage fixed resistor thus formed is then received in an insulating casing for a high-voltage variable resistor unit.

The input lead wire is electrically connected to an output terminal of a fly-back transformer through a connection means. A lead wire, a connector terminal or the like may be used for the connection means. Alternatively, the connection means may be constructed by inserting, into an electrically conductive rubber terminal used as an output terminal of the fly-back transformer, a wire-like terminal to which the input lead wire described above is electrically connected. Japanese Utility Model Publication 18904/1985 discloses use of an electrically conductive rubber terminal for electrical connection between a fly-back transformer and a high-voltage variable resistor unit. A wire-like terminal is fixed on a holder.

SUMMARY OF THE INVENTION

The present invention has been made in view of the foregoing disadvantage of the prior art while taking notice of the fact that as a result of a careful study by the inventors, fixing of a wire-like terminal to a holder by adhesion, welding or the like renders assembling and manufacturing of a high-voltage variable resistor unit highly troublesome, leading to a failure in mass production thereof.

Accordingly, it is an object of the present invention to provide a high-voltage variable resistor unit which is capable of readily and positively accomplishing fixing of a wire-like terminal.

It is another object of the present invention to provide a high-voltage variable resistor unit which is capable of attaching a wire-like terminal to a holder without adhesion, welding or the like.

It is a further object of the present invention to provide a high-voltage variable resistor unit which is capable of accomplishing firm fixing of a lead wire.

It is still another object of the present invention to provide a high-voltage variable resistor unit including a holder which is capable of facilitating charging of insulating resin for molding.

It is yet another object of the present invention to provide a high-voltage fixed resistor which is capable of readily and positively accomplishing fixing of a wire-like terminal.

It is even another object of the present invention to provide a high-voltage fixed resistor which is capable of attaching a wire-like terminal to a holder without adhesion, welding or the like.

It is a still further object of the present invention to provide a high-voltage fixed resistor which is capable of accomplishing firm fixing of a lead wire.

In accordance with one aspect of the present invention, a high-voltage variable resistor unit is provided. The high-voltage variable resistor unit includes a first insulating substrate having a front surface and a rear surface and provided on the front surface thereof with a resistance pattern for a variable resistor, a second insulating substrate having a front surface and a rear surface and formed on the front surface thereof with a resistance pattern for a fixed resistor including a pair of electrodes, and a one-side-open insulating casing of a hollow shape which is made of insulating resin and formed on one side thereof with an opening. The insulating casing is formed therein with a substrate receiving chamber in which the first insulating substrate is received in such a manner that the rear surface of the first insulating substrate faces the opening of the insulating casing and an attachment receiving chamber in which the second insulating substrate is received. Also, the unit includes a wire-like terminal formed by bending a rigid metal wire and a holder made of insulating resin and received in the attachment receiving chamber to hold the second insulating substrate therein. The holder is provided with fitting means in which the wire-like terminal is fittedly received, resulting in the wire-like terminal being kept at a predetermined posture. The unit further includes a first lead wire connected at one end thereof to one of the electrodes and at the other end thereof to one end of the wire-like terminal and a second lead wire connected at one end thereof to the other of the electrodes and at the other end thereof to the terminal fitment electrically connected to the resistance pattern.

Also, in accordance with this aspect of the present invention, a high-voltage variable resistor unit adapted to be mounted on a transformer casing of a fly-back transformer is provided. The unit includes a first insulating substrate having a front surface and a rear surface and provided on the front surface thereof with a resistance pattern for a variable resistor, a second insulating substrate having a front surface and a rear surface and formed on the front surface thereof with a resistance pattern for a fixed resistor including a pair of electrodes, and a one-side-open insulating casing of a hollow shape made of an insulating resin material and formed on one side thereof with an opening. The insulating casing is formed therein with a substrate receiving chamber in which the first insulating substrate is received in such a manner that the rear surface of the first insulating substrate faces the opening of the insulating casing and an attachment receiving chamber in which the second insulating substrate is received. The insulating casing is charged therein through the opening with insulating resin for molding of the fly-back transformer. The unit also includes a wire-like terminal formed by bending a rigid metal wire. The wire-like terminal is arranged so as to extend at both ends thereof toward the opening of the insulating casing and formed at one of both ends thereof into a shape which permits the one end of both ends to be inserted into a terminal provided on a side of the fly-back transformer. The unit further includes a holder made of insulating resin and received in the attachment receiving chamber to hold the second insulating substrate therein. The holder is provided with fitting means in which the wire-like terminal is fittedly received, resulting in the wire-like terminal being kept at a predetermined posture. The holder includes an opening facing wall facing the opening of the insulating casing, which opening facing wall is formed with a plurality of through-holes through which the insulating resin flows. Furthermore, the unit includes a first lead wire connected at one end thereof to one of the electrodes and at the other end thereof to one end of the wire-like terminal and a second lead wire connected at one end thereof to the other of the electrodes and at the other end thereof to the terminal fitment electrically connected to the resistance pattern.

In accordance with another aspect of the present invention, a high-voltage fixed resistor is provided. The resistor includes an insulating substrate having a front surface and a rear surface and formed on the front surface thereof with a resistance pattern including a pair of electrodes, first and second lead wires connected to the electrodes, respectively, and a wire-like terminal formed by bending a rigid metal wire. The wire-like terminal is connected at one end thereof to the first lead wire and provided at the other end thereof with a connection. The resistor also includes a holder of a hollow shape which is made of insulating resin and in which the insulating substrate is heldly received while keeping the first and second lead wires led out of the holder. The holder is provided on an outside thereof with a fitting means in which the wire-like terminal is fittedly received, resulting in the wire-like terminal being kept at a predetermined posture.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

Figure 1A:
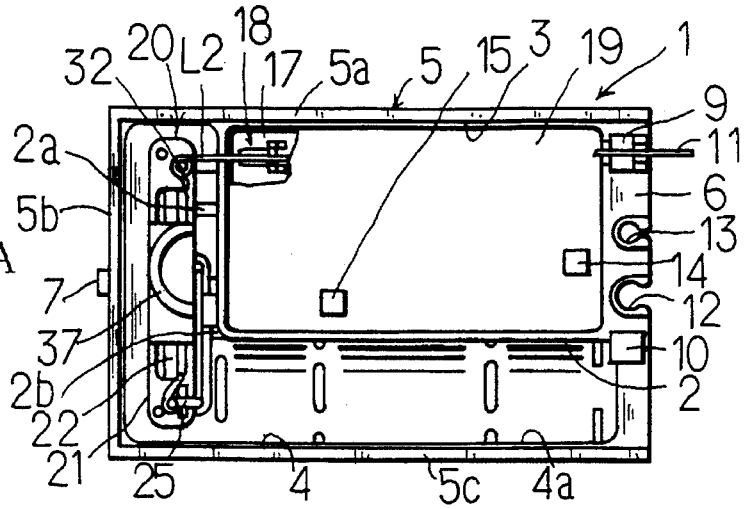
FIG. 1A is a bottom view showing an embodiment of a high-voltage electronic component according to the present invention which is embodied in the form of a high-voltage variable resistor unit.
Figure 1B:
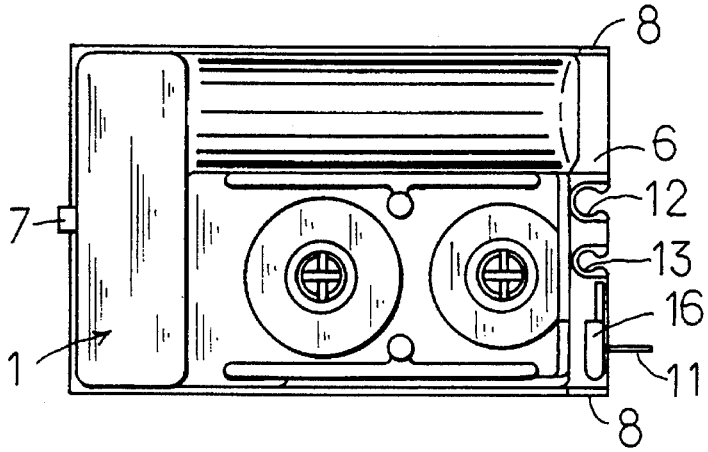
FIG. 1B is a plan view of the high-voltage electronic component shown in FIG. 1A.
Figure 1C:
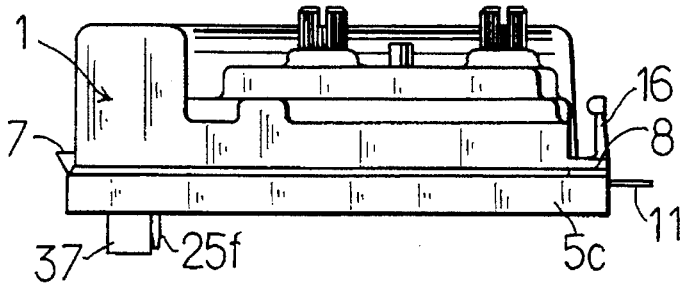
FIG. 1C is a side elevation view of the high-voltage electronic component shown in FIG. 1A.
Figure 1D:
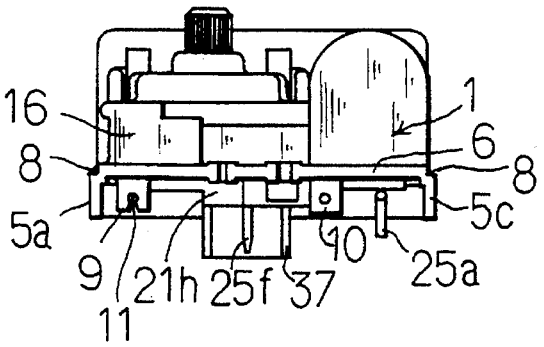
FIG. 1D is a front elevation view of the high-voltage electronic component shown in FIG. 1A.

Now, a high-voltage electronic component according to the present invention will be described hereinafter with reference to the accompanying drawings.

Referring first to FIGS. 1A to 1D, an embodiment of a high-voltage electronic component according to the present invention is illustrated, which is embodied in the form of a high-voltage variable resistor unit. A high-voltage variable resistor unit of the illustrated embodiment is adapted to be mounted on a transformer casing of a fly-back transformer so as to close or cover a variable-resistor-mounting opening of the transformer casing or an opening of the transformer casing through which the high-voltage variable resistor unit is mounted on the transformer casing. The transformer casing may be formed of a synthetic resin material. After the resistor unit is mounted on the transformer casing, an insulating resin material for molding of the transformer is charged in a region extending from an insulating resin charging opening of the transformer casing through an interior of the transformer casing to an opening formed at a rear surface of the high-voltage variable resistor unit. To this end, the high-voltage variable resistor unit includes an insulating casing 1 which is formed into a hollow shape and in a one-side-open manner of providing at a bottom side of the casing 1 with an opening. The insulating casing 1 is formed therein with a substrate receiving chamber 3 and an attachment receiving chamber 4 which are separated from each other through a partition 2. The insulating casing 1 is integrally formed of a synthetic resin material such as polyethylene terephthalate, Noryl (trademark) resin or the like.

The insulating casing 1 is provided with a fit-on wall section 5, which is formed into a substantially U-shape so as to define an internal space of the hollow insulating casing 1. Thus, the fit-on wall section 5 is arranged so as to extend along a whole circumference of the opening, except a side thereof facing the insulating resin charging opening of the transformer casing when it is mounted on the transformer casing. The side of the insulating casing 1 facing the insulating resin charging opening of the transformer casing is formed with a flat-plate section 6 so as to be integral with the insulating casing 1.

The fit-on wall section 5 includes a first wall portion 5*a* and a third wall portion 5*c* arranged on both side ends of the flat-plate section 6 so as to interpose the flat-plate section 6 therebetween and a second wall portion 5*b* arranged in a manner to be spacedly opposite to an inner surface of the flat-plate section 6. The second wall portion 5*b* is mounted on an outer surface thereof with a projection 7 for reinforcement so as to outwardly project therefrom. The reinforcement projection 7 is adapted to be engaged with a reinforcement recess formed on a rising wall which forms a fitment groove defined so as to surround the variable-resistor-mounting opening of the transformer casing, to thereby prevent one end of the insulating casing from being raised when the transformer casing is charged with a thermosetting insulating resin material. The first and third wall portions 5*a* and 5*c* of the fit-on wall section 5 each are formed on an outer surface of an end thereof positioned on the side of the flat-plate section 6 with a step 8 for engagement. The engagement steps 8 each are adapted to be engaged with an engagement projection integrally formed on the above-described rising wall which defines the fitment groove surrounding the variable-resistor-mounting opening of the transformer casing, to thereby prevent the other end of the insulating casing 1 from being lifted.

The flat-plate section 6, as shown in FIG. 1A, is integrally mounted on a bottom end surface thereof with a terminal holding portion 9 and a lead wire holding portion 10. The terminal holding portion 9 is formed so as to permit a terminal 11 to be securely held therein by press fitting. The lead wire holding portion 10 is formed with a through-hole into which an output pin for connecting a lead wire of a capacitor C (FIG. 2) thereto is inserted. Also, the flat-plate section 6 is formed on an outer surface thereof with elongated through-holes 12 and 13 of a C-like shape in cross section so as to vertically extend between the bottom end of the section 6 and a top end thereof. The C-shaped through-holes 12 and 13 function to guide two high-voltage lead wires or a first high-voltage lead wire for screen voltage outputting and a second high-voltage lead wire for focus voltage outputting, respectively. More particularly, the first lead wire is connected to a terminal fitment 14 and then led out via the through-hole 13 to the outer surface of the flat-plate section 6 and the second lead wire is connected to a terminal fitment 15 and then led out via the through-hole 12 to the outer surface of the flat-plate section 6. The two high-voltage lead wires thus lead out to the outer surface of the flat-plate section 6 are then bent so as to extend along the outer surface of the flat-plate section 6, followed by being pressedly fitted between an outer surface of the insulating casing 1 and a holding element 16 provided on the flat-plate section 6.

Figure 2:
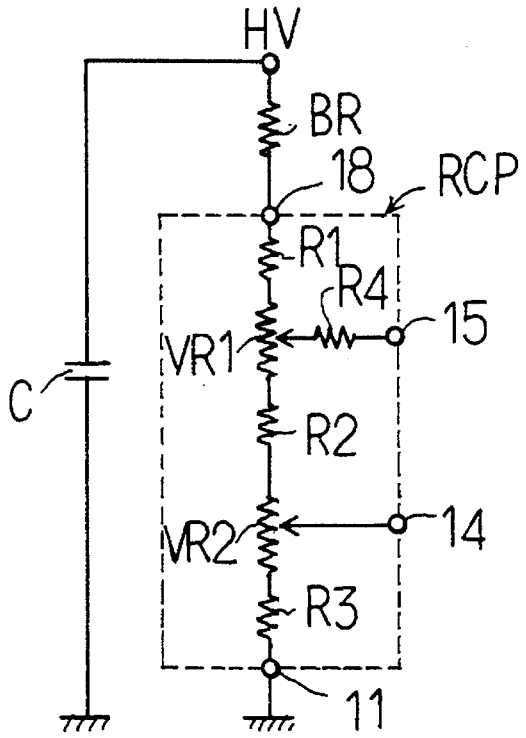
FIG. 2 is a circuit diagram of the high-voltage electronic component shown in FIGS. 1A to 1D.

The terminal 11 and the terminal fitments 14 and 15 are fixedly mounted on a rear surface of an insulating substrate 17 made of a ceramic or porcelain material and arranged in the substrate receiving chamber 3 of the insulating casing 1. The insulating substrate 17 is formed on a front surface thereof with a resistance pattern for a variable resistor which includes a variable resistance element for the focus voltage outputting and a variable resistance element for the screen voltage outputting. The insulating substrate 17 is also securely mounted on the rear surface thereof with a terminal fitment 18 for an input terminal, which will be described hereinafter. A circuit of the resistance pattern formed on the insulating substrate 17 is indicated by reference character RCP in FIG. 2 which is a circuit diagram of the high-voltage variable resistor unit of the illustrated embodiment. In FIG. 2, reference character C designates the capacitor as described above.

Between the insulating substrate 17 and an upper wall of the insulating casing 1 are received a rotor for focusing and a rotor for screening each including a contact contacted with the resistance pattern. The insulating substrate 17 is charged on the rear side thereof with a thermosetting insulating resin material such as epoxy resin for the purpose of enhancing insulation of the insulating substrate and protecting it. The insulating resin charged is cured by heating, to thereby provide an insulating resin layer 19. In FIG. 1A, the insulating resin layer 19 is partially cut away for the purpose of clarify a relationship between a structure of the terminal fitment 18 and a lead wire L2 extending from a high-voltage fixed resistor 20.

Figure 3A:
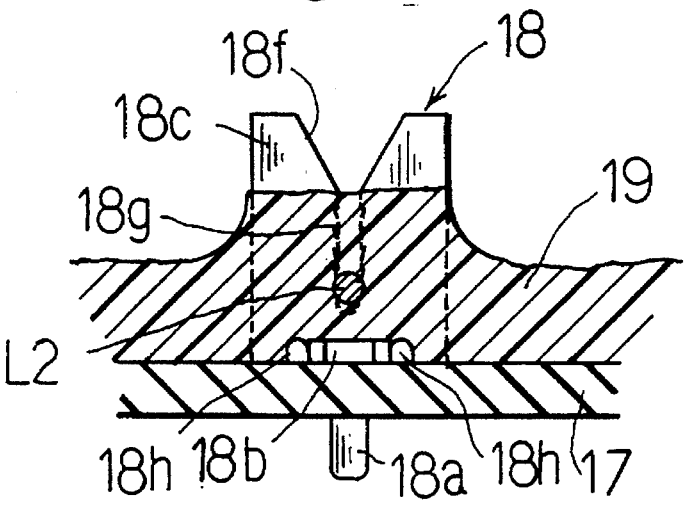
FIGS. 3A and 3B each are a fragmentary schematic sectional view showing a terminal fitment and a lead wire which are embedded in an insulating resin layer.
Figure 3B:
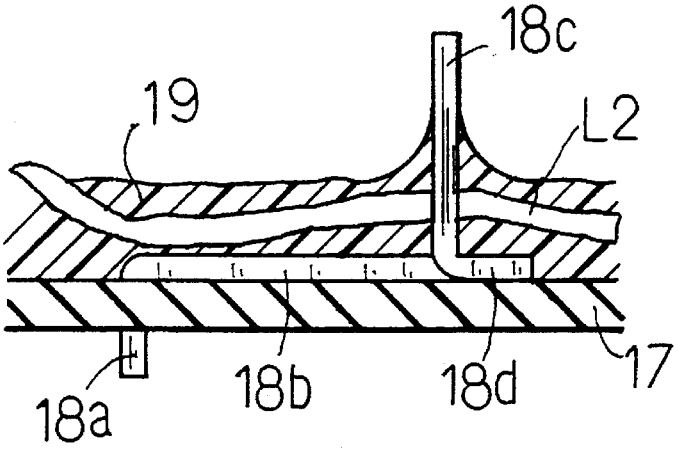
Figure 3C:
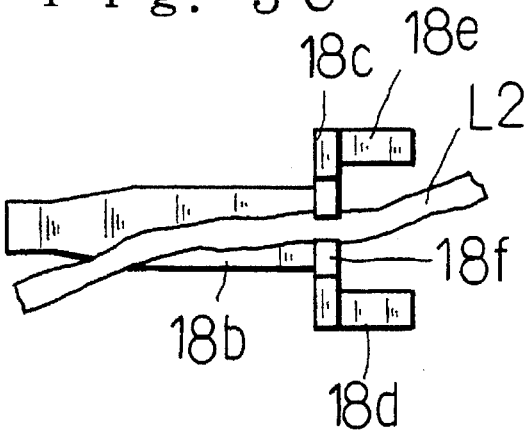
FIG. 3C is a fragmentary schematic view showing a terminal fitment add a lead wire prior to charging of insulating resin.

Now, a structure for connection between the terminal fitment 18 and the lead wire L2 will be described hereinafter with reference to FIGS. 3A to 3C, wherein FIGS. 3A and 3B each show the terminal fitment 18 embedded in the insulating resin layer 19 and FIG. 3C shows the terminal fitment 18 prior to charging of the insulating resin. The terminal fitment 18 includes a connection 18*a* extending through the insulating substrate 17, an extension 18*b* extending from the connection 18*a* along the rear surface of the insulating substrate 17, a lead wire connection 18*c* extending from the extension 18*b* in a direction downwardly away from the insulating substrate 17, and a pair of reinforcements 18*d* and 18*e* each extending from each of both sides of a proximal portion of the lead wire connection 18*c* in a direction horizontally away from the extension 18*b* and along the rear surface of the insulating substrate 17. The connection 18*a* is joined, by soldering, to an electrode formed on the front surface of the insulating substrate 17. The connection 18*a* and extension 18*b* cooperate with each other to provide a terminal section.

The lead wire connection 18*c* is formed into a plate-like shape and provided with a groove in a manner to extend from a distal end thereof toward the extension 18*b* or insulating substrate 17, resulting in providing a lead-wire inlet 18*f* of an inverted frust-conical shape and a lead-wire press-fit channel 18*g* contiguous to the inlet 18*f* which are arranged in order from the distal end of the connection 18*c* toward the insulating substrate 17. The press-fit channel 18*g*, as shown in FIG. 3A, is formed into an elongated shape in section so that one end thereof communicates with the lead-wire inlet 18*f* and the other end thereof terminates at a proximal portion of the lead-wire connection 18*c*. The press-fit channel 18*g* is formed on a surface thereof with a sawtooth-like roughness which functions to securely hold the lead wire L2 in the channel 18*g*. The press-fit channel is so formed that the narrowest portion thereof has a width smaller than a diameter of the lead wire L2 and the widest portion thereof has substantially the same as the diameter of the lead wire L2.

Press fitting of the lead wire L2 in the press-fit channel 18*g* is carried out by inserting the lead wire L2 through the lead-wire inlet 18*f*. The lead-wire inlet 18*f* is formed into a width larger than that of the press-fit channel 18*g*, so that insertion of the lead wire into the press-fit channel 18*g* may be facilitated. Upon press-fitting of the lead wire in the press-fit channel 18*g*, the insulating resin is charged through the opening of the insulating casing 1 in the substrate receiving chamber 3 to form the insulating resin layer 19. The lead wire L2 is preferably embedded at one end thereof in the insulating resin layer 19. When the lead wire L2 is press-fitted in the press-fit channel 18*g* while grasping the lead-wire connection 18*c* of the terminal fitment, force which acts to incline the lead-sire connection 18*c* is applied thereto. Nevertheless, in the illustrated embodiment, the reinforcements 18*d* and 18*e* are arranged so as to extend away from the extension 18*b*, so that a reinforcing action of the reinforcements 18*d* and 18*e* prevents from the force from substantially inclining the lead-wire connection 18*c*.

In the illustrated embodiment, the lead-wire inlet 18*f* is positioned at the distal end of the lead-wire connection 18*c* to permit the lead wire L2 to be inwardly inserted through the lead-wire inlet 18*f* into the press-fit channel 18*g*. Alternatively, the illustrated embodiment may be so constructed that the lead-wire inlet 18*f* is arranged on a side end of the lead-wire connection 18*c*, to thereby permit the lead wire to be laterally inserted through the lead-wire inlet 18*f*. In this instance, the press-fit channel 18*g* may be formed so as to further laterally extend from the lead-wire inlet 18*f*.

Also, in the illustrated embodiment, the lead-wire inlet 18*f* is formed so as to be open on an end surface of the lead-wire connection 18*c*. Alternatively, it may be arranged in the form of a hole which is not open on the end surface of the lead-wire connection 18*c*. In this instance, the lead wire L2 is inserted at one end thereof through the lead-wire inlet 18*g* in a manner like that of threading a needle and then press-fitted in the press-fit channel 18*g*.

The illustrated embodiment may be free of the lead-wire inlet 18*f*. In this instance, the press-fit channel 18*g* is formed at the lead-wire connection 18*c* so as to inwardly extend from the surface of the connection 18*c* thereinto. The press-fit channel 18*g* is formed so as to be open on a vertical surface of the lead-wire connection 18*c* or a horizontal surface thereof.

The high-voltage fixed resistor 20 shown in FIG. 1 constitutes a top bleeder resistance BR shown in FIG. 2 which acts as a fixed resistor. The high-voltage fixed resistor 20 is constructed described hereinafter and received in an inverted manner in the attachment receiving chamber 4 of an L-like shape.

Now, the high-voltage fixed resistor 20 will be more detailedly described hereinafter with reference to FIGS. 4A to 4D which are a plan view of the resistor 20, a side elevation view thereof, a front elevation view thereof and a bottom view thereof, respectively.

The high-voltage fixed resistor 20 includes a holder 21 made of an insulating resin material into a hollow shape and a resistance-formed substrate or second substrate 22 received in the holder 21. The resistance-formed substrate includes a substrate made of a ceramic material and a resistance pattern (not shown) for a fixed resistor formed on a front surface of the substrate and including a pair of electrodes, to which first and second lead wires L1 and L2 are connected, respectively. The holder 21 includes a holder body 21*a* which is formed into a hollows shape and provided on a bottom side thereof with an opening, through which the resistance-formed substrate 22 is received in the holder body 21*a*. The holder body 21*a* includes first and third walls 21*b* and 21*d* each arranged so as to be opposite to a surface of the resistance-formed substrate 22 and spaced at a predetermined interval therefrom, as well as second and fourth walls 21*c* and 21*e* each arranged so as to connect opposite ends of the walls 21*b* and 21*d* to each other therethrough. Also, the holder body 21*a* includes a top wall provided with first and second lateral sections 21*f* and 21*g* and a curved cover 21*h* formed into an upwardly projected C-like shape and arranged so as to cover a central portion of the top wall.

In the illustrated embodiment, as briefly described above, the resistor 20 is received in the insulating casing through the opening of the insulating casing while being inverted as will be noted from FIG. 1A. Thus, the top wall of the holder body 21*a* can be called a wall of the holder body 21*a* facing the opening of the insulating casing when the resistor 20 is received in the casing 1. Thus, the top wall is also referred to as an "opening facing wall" herein.

The first wall 21*b* of the holder body 21*a* is provided on an outer surface thereof with hooks 23 and 24, which are adapted to be engagedly fitted in the recesses 2*a* and 2*b* for engagement provided on the partition 2 of the insulating casing 1. The hooks 23 and 24 are provided with projections 23*a* and 24*a* outwardly projected therefrom, respectively, which serve to prevent engagement between the first wall 21*b* and the partition 2 of the insulating casing 1 through the hooks 23 and 24 and recesses 2*a* and 2*b* from being loosened, to thereby render the engagement firm.

Figure 5:
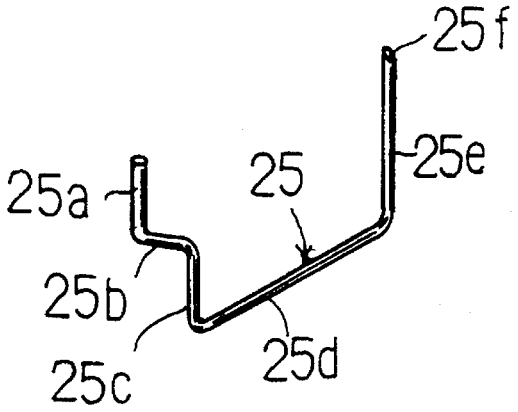

Reference numeral 25 designates a wire-like terminal which provides a means for electrically connecting an output terminal provided on a side of the fly-back transformer and the first lead wire L1 acting as an input of the high-voltage resistor 20 to each other. The wire-like terminal 25 is formed by bending a metal wire which is bendable and has a degree of rigidity, such as, for example, a piano wire. The wire-like terminal 25, as shown in FIG. 5, includes a connection terminal portion 25*a* formed so as to rise on the holder 21, a first fitted portion 25*b* connected at one end thereof to one end of the connection terminal portion 25*a* so as to extend in a direction perpendicular thereto and along the lateral section 21*f* of the top wall of the holder body 21*a*, a second fitted portion 25*c* connected at one end thereof to the other end of the first fitted portion 25*b* so as to extend in a direction perpendicular thereto and along the first wall 21*b* of the holder body 21*a*, a third fitted portion 25*d* connected at one end thereof to the other end of the second fitted portion so as to extend in a direction perpendicular thereto and along the wall 21*b* of the holder body 21*a*, and a fourth fitted portion 25*e* connected at one or proximal end thereof to the other end of the third fitted portion 25*d* so as to extend in a direction perpendicular thereto and provided at the other or distal end thereof with a needle-like connection 25*f*. The connection 25*f* is adapted to be inserted into an electrically conductive rubber terminal provided on a side of the fly-back transformer.

The first wall 21*b* of the holder body 21*a* is provided on an outer surface of an upper portion thereof with first and second discrete fitting members 26 and 27 in a manner to be positionally separated from each other, in which the wire-like terminal 25 is fittedly received. Also, a third discrete fitting member 28 is arranged on the first lateral section 21*f* of the top wall of the holder body 21*a*. Thus, it will be noted that the third discrete fitting member 28 is arranged in a manner to be positionally separated from the first and second discrete fitting members 26 and 27. The third discrete fitting member 28 includes a pair of opposite elements between which the first fitted portion 25*b* of the wire-like terminal 25 is fittedly held. The first discrete fitting member 26 is formed into a pocket-like shape in a manner to be open at an upper end thereof and at one of side ends thereof, so that a space or gap is formed between the first wall 21*b* of the holder body 21*a* and an inner surface of the first discrete fitting member 26. Also, the first discrete fitting member 26 is formed at a bottom thereof with a slit 26*a* for promoting distribution of the insulating resin in the member 26 and/or charging of the resin therein. The first discrete fitting member 26 is fitted therein with the second fitted portion 25*c* of the wire-like terminal 25, as well as a part of the third fitted portion 25*d* of the terminal 25. The second discrete fitting member 27 is likewise formed into a pocket-like shape in which an upper end thereof and one of side ends thereof are open, so that a space or gap is formed between the first wall 21*b* and an inner surface of the second discrete fitting member 27. Also, the second discrete fitting member 27 is formed so as extend to the curved wall 21*h* of the holder body 21*a*. The second discrete fitting member 27 thus formed is fitted therein with a part of the third fitted portion 25*d* of the wire-like terminal 25 and the fourth fitted portion 25*e* of the terminal 25. The space or gap between the first wall 21*b* of the holder body 21*a* and each of the first and second discrete fitting members 26 and 27 is partially or wholly formed into a dimension smaller than a diameter of the wire-like terminal 25. When the gap is formed at a part thereof into a dimension smaller than the diameter, at least one of the inner surface of the first or second discrete fitting member 26 or 27 and the first wall 21*b* may be provided thereon with a projection for adjusting the gap.

Figure 4A:
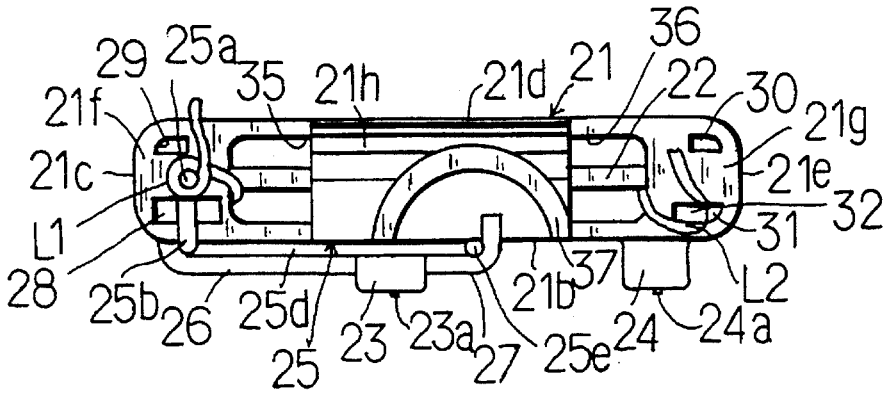
FIG. 4A is a plan view showing a high-voltage fixed resistor incorporated in the high-voltage electronic component shown in FIG. 1A in an inverted manner.
Figure 4B:
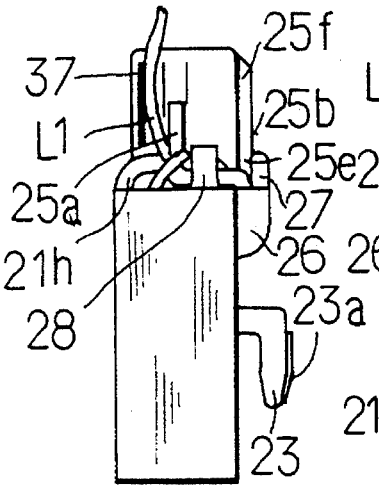
FIG. 4B is a side elevation view of the high-voltage fixed resistor shown in FIG. 4A.
Figure 4C:
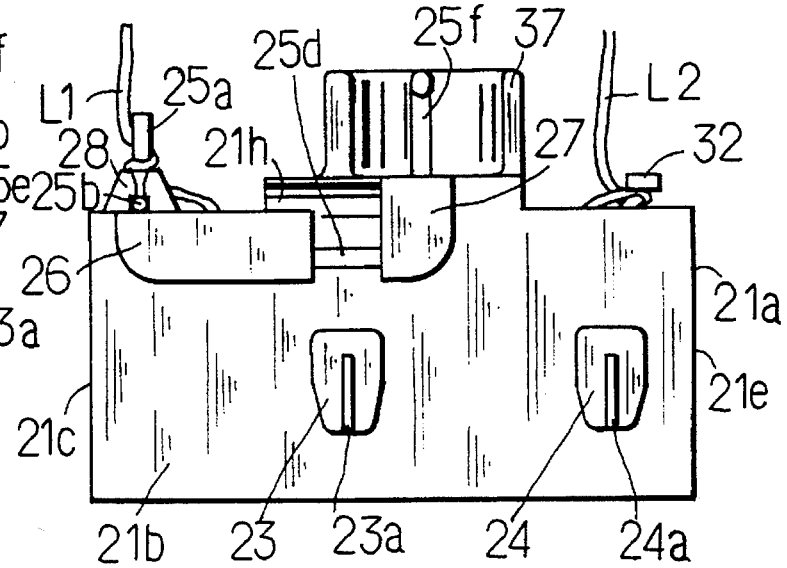
FIG. 4C is a front elevation view of the high-voltage fixed resistor shown in FIG. 4A.
Figure 4D:
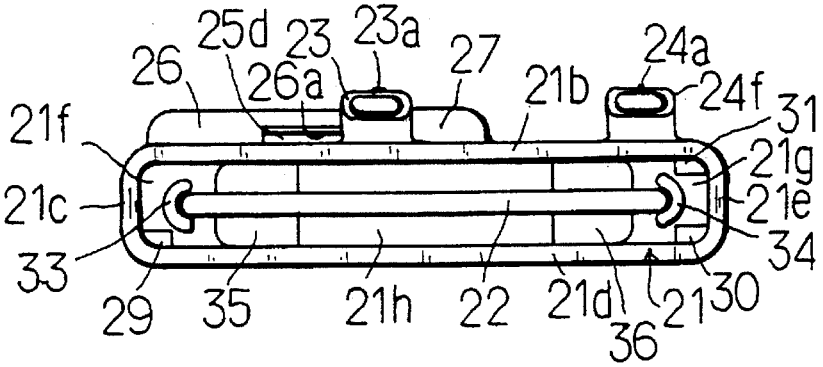
FIG. 4D is a bottom view of the high-voltage fixed resistor shown in FIG. 4A.

The first lateral section 21*f* of the top wall of the holder body 21*a* is formed with a through-hole 29 via which the insulating resin flows thereinto. The second lateral section 21*g* of the top wall is formed with two through-holes 30 and 31 via which the insulating resin is fed into the holder body 21*a*. Also, the second lateral section 21*g* is integrally mounted thereon with a hook-like holding member 32 on which the second lead wire L2 is heldly wound. In addition, the first and second lateral sections 21*f* and 21*g*, as shown in FIG. 4D, are provided on a lower surface thereof with sandwiching members 33 and 34, respectively, which cooperate with each other to securely sandwich the resistance element substrate 22 therebetween.

The top wall of the holder body 21*a* which is also referred to as the opening facing wall is formed with throughholes 35 and 36 via which the first and second lead wires L1 and L2 are led out of the holder 21. The first lead wire L1 is wound on the connection terminal portion 25*a* of the wire-like terminal 25 and then joined thereto by soldering. The connection terminal portion 25*a* is also connected thereto a lead wire of the capacitor C (FIG. 2) received in a capacitor receiving section 4*a* of the attachment receiving chamber 4. The second lead wire L2 is wound on the holding member 32 and then joined to the terminal fitment 18 as shown in FIG. 1A.

The lead wire L2 may be connected directly to the connector fitment 18. However, application of undue force to a connection between the lead wire L2 and the electrode sections of the second insulating substrate leads to a failure in connection therebetween. In order to avoid the problem, the outer surface of the holder 21 may be provided with the holding member 32 for holding the lead wire L2 on the outer surface of the holder 21, resulting in minimizing application of the force to the connection.

The curved wall 21*h* of the holder body 21*a* is provided thereon with a terminal guide 37 of a semi-cylindrical shape in a manner to be integral therewith. The terminal guide 37 is arranged so as to surround a half of the needle-like connection 25*f* of the wire-like terminal 25 and serves to guide the connection portion 25*f* when the connection 25*f* is inserted into the electrically conductive terminal arranged on the transformer casing of the fly-back transformer.

The high-voltage variable resistor unit of the illustrated embodiment is mounted through the opening thereof on the transformer casing of the fly-back transformer and then charged with the insulating resin for molding of the fly-back transformer. The insulating resin is also charged in the holder 21 via the through-holes 29 to 32 and 35 and 36 of the holder body 21*a*.

The high-voltage fixed resistor 20 incorporated in the high-voltage variable resistor unit of the illustrated embodiment is so constructed that the first to third discrete fitting members 26 to 28 are arranged on the first wall 21*b* and the top wall or opening facing wall of the holder body 21*a* perpendicular to the first wall 21*b* in a manner to be positionally separated from each other, so that the wire-like terminal 25 may be kept at a desired posture by merely fittedly holding the wire-like terminal 25 in the discrete fitting members 26 to 28. Thus, the discrete fitting members 25 to 28 are arranged on the different walls of the holder body, so that the wire-like terminal 25 may be positioned on the holder body while straddling a corner defined between the walls, resulting in being firmly held on the holder body.

What is claimed is:

1. A high-voltage variable resistor unit comprising:

a first insulating substrate having a front surface and a rear surface and provided on said front surface thereof with a resistance pattern for a variable resistor;

a second insulating substrate having a front surface and a rear surface and formed on said front surface thereof with a resistance pattern for a fixed resistor including a pair of electrodes;

a one-side-open insulating casing of a hollow shape which is made of insulating resin and formed on one side thereof with an opening;

said insulating casing being formed therein with a substrate receiving chamber in which said first insulating substrate is received in such a manner that said rear surface of said first insulating substrate faces said opening of said insulating casing and an attachment receiving chamber in which said second insulating substrate is received;

a wire-like terminal formed by bending a rigid metal wire;

a holder made of insulating resin and received in said attachment receiving chamber to hold said second insulating substrate therein;

said holder being provided with fitting means in which said wire-like terminal is fittedly received, resulting in said wire-like terminal being kept at a predetermined posture;

a first lead wire connected at one end thereof to one of said electrodes and at the other end thereof to one end of said wire-like terminal; and a second lead wire connected at one end thereof to the other of said electrodes and at the other end thereof to said terminal fitment electrically connected to said resistance pattern.

2. A high-voltage variable resistor unit as defined in claim 1, wherein said holder includes a holder body which is formed into a hollow shape and provided on one side thereof with an opening through which said second substrate is received;

said fitting means includes at least one discrete fitting member arranged on an opening facing wall of said holder body facing said opening of said insulating casing and at least one discrete fitting member arranged on one of side walls of said holder body adjacent to said opening facing wall; and said wire terminal includes a portion extending along said opening facing wall of said holder body facing said opening of said insulating casing and portions each extending along said one side wall of said holder body and is projected at both ends thereof from said opening of said insulating casing.

3. A high-voltage variable resistor unit as defined in claim 2, wherein said first and second lead wires are led out of said holder body through at least two through-holes formed through said opening facing wall of said holder body;

said opening facing wall of said holder body being provided thereon with a holding member for holding said second lead wire.

4. A high-voltage variable resistor unit adapted to be mounted on a transformer casing of a fly-back transformer, comprising:

a first insulating substrate having a front surface and a rear surface and provided on said front surface thereof with a resistance pattern for a variable resistor;

a second insulating substrate having a front surface and a rear surface and formed on said front surface thereof with a resistance pattern for a fixed resistor including a pair of electrodes;

a one-side-open insulating casing of a hollow shape made of an insulating resin material and formed on one side thereof with an opening;

said insulating casing being formed therein with a substrate receiving chamber in which said first insulating substrate is received in such a manner that said rear surface of said first insulating substrate faces said opening of said insulating casing and an attachment receiving chamber in which said second insulating substrate is received;

said insulating casing being charged therein through said opening with insulating resin for molding of said fly-back transformer;

a wire-like terminal formed by bending a rigid metal wire;

said wire-like terminal being arranged so as to extend at both ends thereof toward said opening of said insulating casing and formed at one of said both ends thereof into a shape which permits said one end of said both ends to be inserted into a terminal provided on a side of said fly-back transformer;

a holder made of insulating resin and received in said attachment receiving chamber to hold said second insulating substrate therein;

said holder being provided with fitting means in which said wire-like terminal is fittedly received, resulting in said wire-like terminal being kept at a predetermined posture;

said holder including an opening facing wall facing said opening of said insulating casing, said opening facing wall being formed with a plurality of through-holes through which said insulating resin flows;

a first lead wire connected at one end thereof to one of said electrodes and at the other end thereof to one end of said wire-like terminal; and a second lead wire connected at one end thereof to the other of said electrodes and at the other end thereof to said terminal fitment electrically connected to said resistance pattern.

5. A high-voltage variable resistor unit as defined in claim 4, wherein said holder includes a holder body which is formed into a hollow shape and provided on one side thereof with an opening through which said second substrate is received; and said fitting means includes at least one discrete fitting member arranged on said opening facing wall of said holder body facing said opening of said insulating casing and at least one discrete fitting member arranged on one of side walls of said holder body adjacent to said opening facing wall.

6. A high-voltage variable resistor unit as defined in claim 4, wherein said wire-like terminal includes a connection terminal portion to which said first lead wire is connected, a first fitted portion connected at one end thereof to one end of said connection terminal portion so as to extend in a direction perpendicular thereto and along said opening facing wall of said holder body facing said opening of said insulating casing, a second fitted portion connected at one end thereof to the other end of said first fitted portion so as to extend in a direction perpendicular thereto and along said one side wall of said holder body, a third fitted portion connected at one end thereof to the other end of said second fitted portion so as to extend in a direction perpendicular thereto and along said one side wall of said holder body, a fourth fitted portion connected at one thereof to the other end of said third fitted portion so as to extend in a direction perpendicular thereto and in the same direction as said connection terminal portion, and a connection provided on the other end of said fourth fitted portion; and said fitting means in which said wire-like terminal is fittedly held includes a first discrete fitting member in which said second fitted portion of said wire-like terminal and a part of said third fitted portion thereof are fitted, a second discrete fitting member in which a part of each of said third fitted portion and fourth fitted portion of said wire-like terminal is fitted, and a third discrete fitting member in which said first fitted portion of said wire-like terminal is fitted.

7. A high-voltage variable resistor unit as defined in claim 5, wherein a wall of said insulating casing by which said attachment receiving chamber is defined is provided thereon with two engagement recesses; and said holder body is provided on said one side wall thereof with two hooks which are engagedly fitted in said engagement recesses, respectively;

engagement between said recesses and said hooks leading to holding of said holder on said insulating casing.

8. A high-voltage variable resistor unit as defined in claim 7, wherein said hooks each are provided on an outside thereof with a projection which is adapted to be deformed when it is pressed against said wall of said insulating casing by which said attachment receiving chamber is defined.

9. A high-voltage fixed resistor comprising:

an insulating substrate having a front surface and a rear surface and formed on said front surface thereof with a resistance pattern including a pair of electrodes;

first and second lead wires connected to said electrodes, respectively;

a wire-like terminal formed by bending a rigid metal wire;

said wire-like terminal being connected at one end thereof to said first lead wire and provided at the other end thereof with a connection; and a holder of a hollow shape which is made of insulating resin and in which said insulating substrate is securely received while keeping said first and second lead wires extending out of said holder;

said holder being provided on an outside thereof with a fitting means in which said wire-like terminal is fittedly received, resulting in said wire-like terminal being kept at a predetermined posture.

10. A high-voltage fixed resistor as defined in claim 9, wherein said holder is provided with a holding member for holding said second lead wire.

11. A high-voltage fixed resistor as defined in claim 9, wherein said holder includes a holder body which is formed into a hollow shape and provided with an opening through which said insulating substrate is received therein; and said fitting means includes at least one discrete fitting member arranged on an opening facing wall of said holder body facing said opening of said insulating casing and at least one discrete fitting member arranged on one of side walls of said holder body adjacent to said opening facing wall.

* * * * *